US006481419B2

(12) United States Patent
Boecking

(10) Patent No.: US 6,481,419 B2
(45) Date of Patent: Nov. 19, 2002

(54) UNIT INJECTOR SYSTEM WITH PREINJECTION

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 25 days.

(21) Appl. No.: 09/742,012

(22) Filed: Dec. 22, 2000

(65) Prior Publication Data

US 2001/0032623 A1 Oct. 25, 2001

(30) Foreign Application Priority Data

Dec. 28, 1999 (DE) ..... 199 63 370

(51) Int. Cl.[7] ..... F02M 41/60
(52) U.S. Cl. ..... 123/467; 123/496
(58) Field of Search ..... 123/467, 299, 123/300, 498, 499, 496; 239/88, 93

(56) References Cited

U.S. PATENT DOCUMENTS 4,211,202 A * 7/1980 Hafner ..... 123/457
4,813,601 A * 3/1989 Schwerdt et al. ..... 239/91
5,370,095 A * 12/1994 Yamaguchi et al. ..... 123/446
5,462,252 A * 10/1995 Thomas ..... 251/25
5,934,570 A * 8/1999 Lambert ..... 239/533.3
6,240,905 B1 * 6/2001 Boecking ..... 123/498

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

The invention relates to a unit injector system for internal combustion engines, in particular diesel engines, having a pump element for subjecting fuel in a pump chamber to high pressure, having an injection element for injecting the pressurized fuel into the combustion chamber of the engine, and having a control valve, which opens and closes a connection between the pump chamber and a low-pressure chamber. To make a preinjection possible, a throttle device (13) is disposed in the connection between the pump chamber and the low-pressure chamber, and there is a flow through the throttle device as a function of the position of the control valve.

8 Claims, 2 Drawing Sheets

UNIT INJECTOR SYSTEM WITH PREINJECTION

FIELD OF THE INVENTION

This invention relates to a unit injector system for internal combustion engines, and more particularly to such a system for diesel engines having a pump element for subjecting fuel in a pump chamber to high pressure, an injection element for injecting the pressurized fuel into the combustion chamber of the engine, and a control valve which opens and closes a connection between the pump chamber and a low-pressure chamber.

BACKGROUND OF THE INVENTION

One such unit injector system, or UIS for short, is described in German Patent Disclosure DE 198 35 494, which had not been published by the priority date of the present application. In a UIS, the pump element and the injection element form a unit, and one such unit is typically built into each cylinder head of the engine. The drive of the UIS is done either via a tappet or indirectly from the camshaft via rockers.

A 2/2-way valve can be used as the control valve. In the first position of the 2/2-way valve, the connection between the pump chamber and the low-pressure chamber is open. Then filling of the pump chamber is possible during the intake stroke, and during the pumping stroke a return flow of fuel to the low-pressure chamber is possible. In the second position of the 2/2-way valve, the connection between the pump chamber and the low-pressure chamber is interrupted. Then, the pressure required for injecting the fuel is built up in the pump chamber. Once the pressure exceeds a predetermined opening pressure, the injection element opens, and the pressurized fuel is injected into the engine combustion chamber. The closing time of the control valve thus determines the injection onset. The injection quantity depends on the closing duration of the control valve. To reduce fuel consumption and pollutants, a so-called preinjection of a slight fuel quantity can be performed before the actual main injection.

SUMMARY OF THE INVENTION

The object of the invention is to furnish a unit injector system of the type described at the outset, with preinjection, that is simple in structure and can be produced economically.

In a unit injector system for internal combustion engines, in particular diesel engines, having a pump element for subjecting fuel in a pump chamber to high pressure, having an injection element for injecting the pressurized fuel into the combustion chamber of the engine, and having a control valve, which opens and closes a connection between the pump chamber and a low-pressure chamber, this object is attained in that a throttle device is disposed in the connection between the pump chamber and the low-pressure chamber, and there is a flow through the throttle device as a function of the position of the control valve.

The throttle limits the fuel quantity that flows through the connection between the pump chamber and the low-pressure chamber and thus in a simple way makes it possible to define a preinjection.

One embodiment of the invention is characterized in that the control valve includes a first valve body with a first valve seat face and a second valve body with a second valve seat face, which are received, capable of reciprocation, in a housing. The cooperation of the two valve bodies enables a precise setting of different strokes of the valve bodies.

A further embodiment of the invention is characterized in that the control valve is a 3/3-way valve. In the first position of the 3/3-way valve, the connection between the pump chamber and the low-pressure chamber is interrupted. In the second position of the 3/3-way valve, because of the throttle device, less fuel flows through the connection between the pump chamber and the low-pressure chamber than in the third valve position. The lesser fuel quantity is used for the preinjection. In the third position of the 3/3-way valve, a connection, provided parallel to the throttle device, to the low-pressure chamber enables normal filling of the pump chamber.

A further embodiment of the invention is characterized in that in a first valve position, the first valve body is spaced apart from the second valve body, and both the first valve body having the first valve seat face and the second valve body having the second valve seat face rest on their associated valve seat edges, as a result of which the connection between the pump chamber and a low-pressure chamber is closed;

that in a second valve position, the first valve body comes to rest on the second valve body, and the first valve body having the first valve seat face lifts from its associated valve seat edge, as a result of which fuel can flow to a throttle in the second valve body, which throttle communicates with the low-pressure chamber;

and that in a third valve position, the second valve body comes to rest on a stroke end stop, and both the first valve body having the first valve seat face and the second valve body having the second valve seat face are lifted from their associated valve seat edges, as a result of which a connection without a throttle is opened up to the low-pressure chamber. The first valve body can be kept in contact, with the first valve seat face, on the associated valve seat edge by a first valve closing spring. The actuation of the first valve body can be done by means of a magnet or a piezoelectric actuator. The second valve body can be kept in contact, with the second valve seat face, on the associated valve seat edge by means of a second valve closing spring. As a result, it is assured that in the unactuated state, the control valve is closed.

A further embodiment of the invention is characterized in that a groove is recessed out of the end face, toward the second valve body, of the first valve body. The groove assures that fuel can reach the throttle in the second valve body when the two valve bodies are in contact with one another.

A further embodiment of the invention is characterized in that a groove is embodied on the stroke end stop. The groove prevents the formation of a pressure cushion during operation between the second valve body and the stroke end stop, that could unfavorably affect the injection performance.

A further embodiment of the invention is characterized in that the control valve is a 2/3-way valve. In the first position of the 2/3-way valve, the connection between the pump chamber and the low-pressure chamber is interrupted. In the first position of the 2/3-way valve, the connection between the pump chamber and the low-pressure chamber is interrupted. In the second position of the 2/3-way valve, because of the throttle device, less fuel flows through the connection between the pump chamber and the low-pressure chamber than in the third valve position. The lesser fuel quantity is used for the preinjection. In the third position of the 2/3-way valve, a connection, provided parallel to the throttle device, to the low-pressure chamber enables normal filling of the pump chamber.

A further embodiment of the invention is characterized in that the first valve body has a central bore, in which part of the second valve body is displaceably received;

that in a first valve position, the first valve body is spaced apart from a stroke stop on the second valve body, and both the first valve body having the first valve seat face and the second valve body having the second valve seat face rest on their associated valve seat edges, as a result of which the connection between the pump chamber and the low-pressure chamber is closed;

that in a second valve position, the first valve body comes to rest on the stroke stop of the second valve body, and the first valve body having the first valve seat face lifts from its associated valve seat edge, as a result of which fuel can flow to a throttle in the second valve body, which throttle communicates with the low-pressure chamber;

and that in a third valve position, the second valve body comes to rest on a stroke end stop, and both the first valve body having the first valve seat face and the second valve body having the second valve seat face are lifted from their associated valve seat edges, as a result of which a connection to the low-pressure chamber without a throttle is opened up. The first valve body can be kept in contact, with the first valve seat face, on the associated valve seat edge by a first valve closing spring. The actuation of the first valve body can be done by means of a magnet or a piezoelectric actuator. The second valve body can be kept in contact, with the second valve seat face, on the associated valve seat edge by means of a second valve closing spring. As a result, it is assured that in the unactuated state, the control valve is closed.

A further embodiment of the invention is characterized in that the second valve body in the built-in state is substantially balanced in terms of force. As a result, it is attained that a closing spring of small dimensions can be used for the second valve body.

A further embodiment of the invention is characterized in that the throttle has a constant flow diameter. The throttle can be manufactured as an independent component with high precision. As a result, it is possible to achieve a preinjection quantity with highly accurate replicability.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
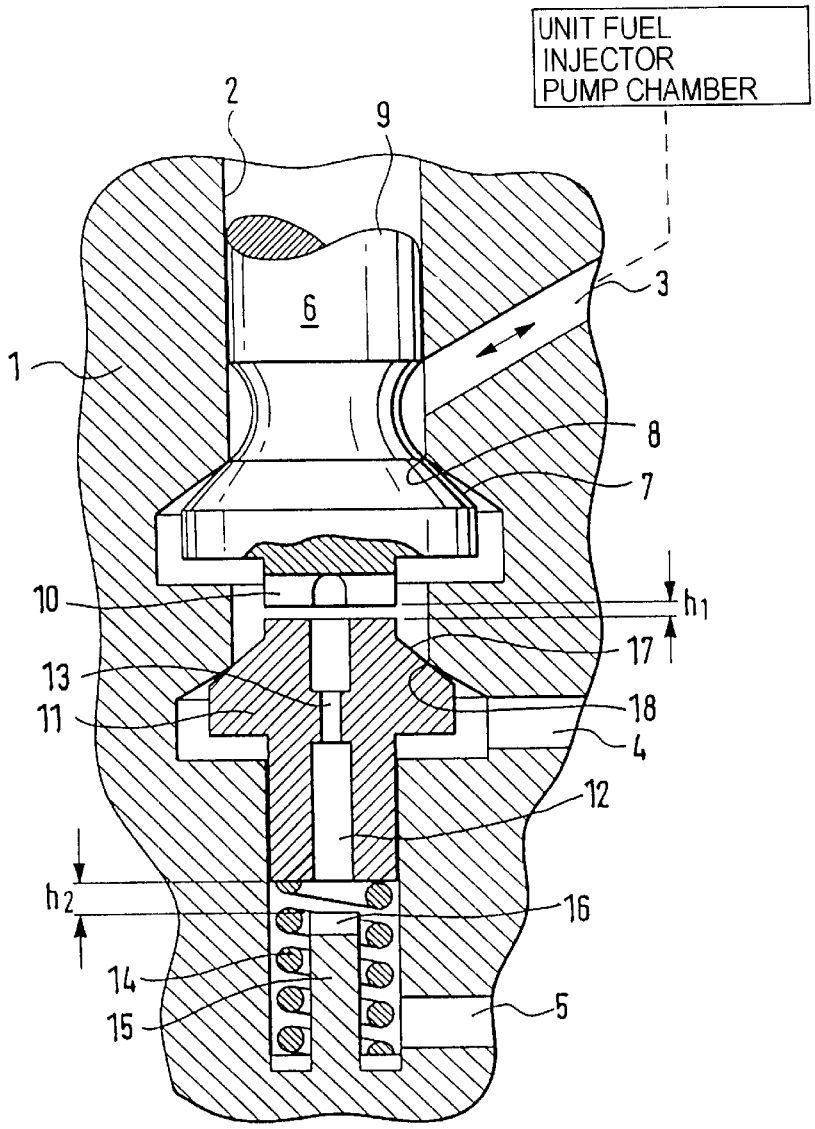
FIG. 1 is a sectional view of a control valve in a first embodiment of the invention.

In FIG. 1, the control valve of a unit injector system according to the invention is shown in section. The unit injector system is used to deliver fuel to the combustion chamber of direct-injection internal combustion engines. The unit injector system includes a pump element for building up the injection pressure and an injection nozzle for injecting the fuel into the combustion chamber. The course of injection is controlled by the control valve.

The control valve shown in FIG. 1 includes a valve housing 1, and a bore 2 is recessed out of the valve housing 1. Discharging into the bore 2 is a connecting conduit 3 to the pump chamber (not shown), where the injection pressure is built up. A first connecting conduit 4 and a second connecting conduit 5 also extend from the bore 2 in the valve housing 1 to a low-pressure chamber (not shown). In the intake stroke, fuel from the low-pressure chamber reaches the pump chamber. In the pumping stroke, the low-pressure chamber serves to receive returning fuel and leakage. The low-pressure pressure chamber can for instance be a line system that communicates with a fuel tank.

A first valve body 6 is received, in a manner capable of reciprocation, in the bore 2 in the valve housing 1, in the region where the connecting conduit 3 discharges into the pump chamber. On the first valve body 6, a first valve seat face 7 is formed, which is in contact with a first valve seat edge 8 that is embodied in the valve housing 1. One end 9 of the first valve body 6 is shown in cutaway form. The end 9, shown cut away, of the first valve body 6 is coupled with an actuating device (not shown). The actuating device can for instance be a magnet or a piezoelectric actuator. A groove 10 is formed in the end face on the other end of the first valve body 6.

The first valve body 6 is spaced apart with its free end from a second valve body 11 by a spacing or stroke $h_1$. A second valve seat face 17 is embodied on the second valve body 11; it is in contact with a second valve seat edge 18 that is embodied in the valve housing 1. The second valve body 11 furthermore has a central through bore 12, in which a throttle 13 is embodied. The second valve body 11 is kept in contact with the second valve seat edge 18 by a closing spring 14. A stroke end stop 15 with a groove 16 is spaced apart from one end face of the second valve body 11 by a spacing or stroke $h_2$.

The position shown in FIG. 1 of the control valve according to the invention will be called the first switching position. In the first switching position, the connection between the pump chamber and the low-pressure chamber is interrupted. When the first valve body 6 is moved by the stroke $h_1$, for instance by magnet actuation, and put into contact with the second valve body 11, the first valve seat face 7 lifts from the associated first valve seat edge 8. The position, not shown in FIG. 1, of the control valve of the invention will be called the second switching position. In the second switching position of the control valve, a connection between the low-pressure chamber and the pump chamber is opened up via the connecting conduit 3, the groove 10, the through bore 12, the throttle 13, and the second connecting conduit 5.

When the first valve body 6 together with the second valve body 11 is moved onward by the stroke $h_2$, the second valve seat face 17 now also lifts up from the associated second valve seat edge 18. This position of the control valve of the invention will be called the third switching position. In the third switching position, an additional connection is opened between the low-pressure chamber and the pump chamber, via the connecting conduit 3 and the first connecting conduit 4.

In the first switching position of the control valve according to the invention, the connection between the pump chamber and the low-pressure chamber is interrupted and the main injection takes place. In the second switching position of the control valve of the invention, the fuel flows through the throttle 13, and a so-called preinjection is effected.

Figure 2:
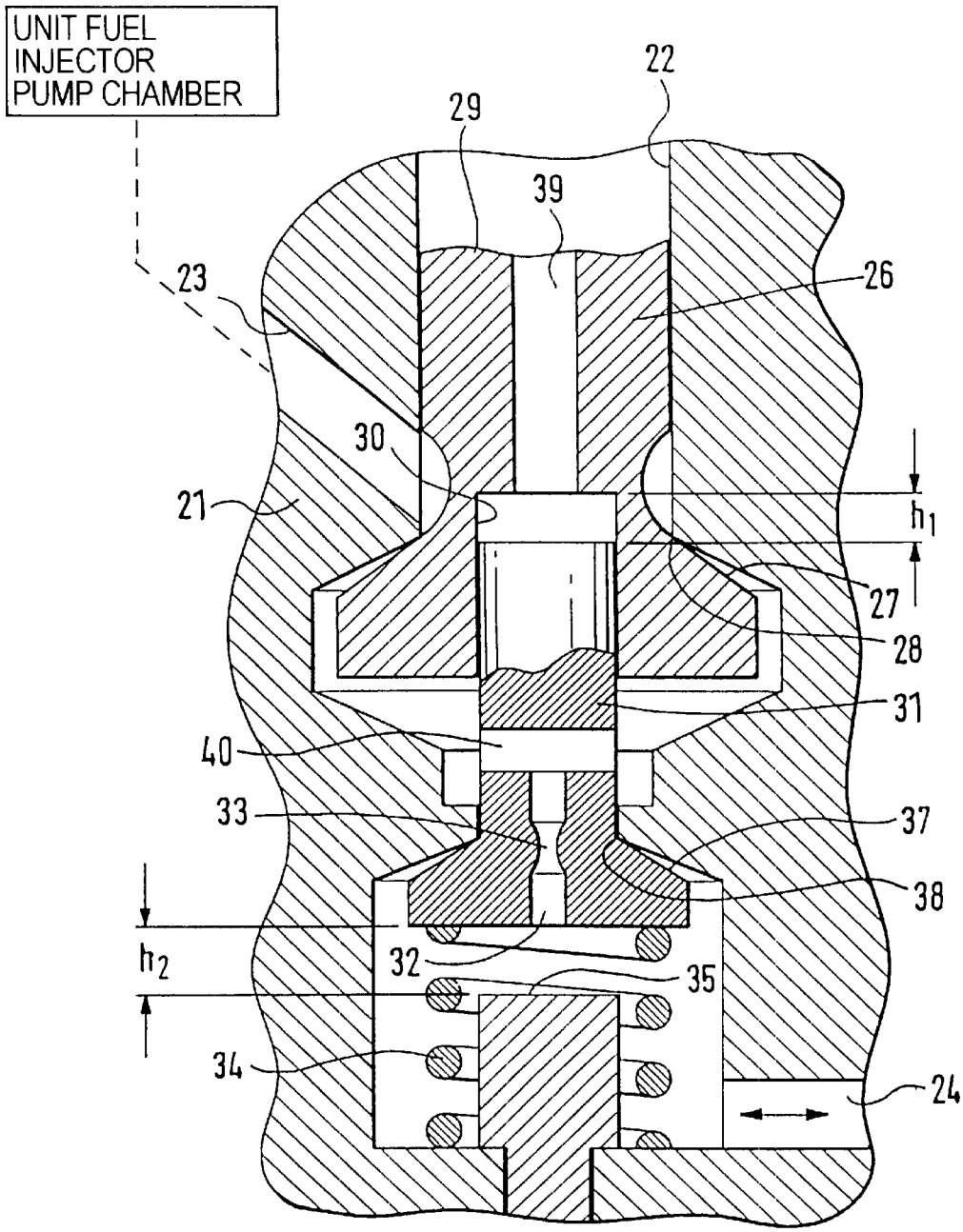
FIG. 2 is a sectional view of a control valve in a second embodiment of the invention.

In FIG. 2, a second embodiment of a control valve of a unit injector system according to the invention is shown in section. The control valve has a valve housing 21. A bore 22 is recessed out of the valve housing 21. Discharging into the bore 22 are a connecting conduit 23 to the pump chamber and a connecting conduit 24 to the low-pressure chamber of the unit injector system of the invention. In the region where the connecting conduit 23 discharges into the pump chamber, a first valve body 26 is received, in a manner capable of reciprocation, in the bore 22. On the first valve body 26, a first valve seat face 27 is embodied, which is in contact with a first valve seat edge 28 embodied in the valve housing 21. An end 29, shown cut away, of the first valve body 26 is actuated by a magnet. A central bore is recessed out of the first valve body 26. The central bore in the valve body 26 includes one bore segment 30 with a large diameter and one bore segment 39 with a small diameter. The bore segment 39 with the small diameter is used for removing leaking fuel. The bore segment 30 with the large diameter is used for receiving a portion of a second valve body 31 in a manner capable of reciprocation. On the second valve body 31, there is a second valve seat face 37, which is in contact with a second valve seat edge 38 in the valve housing 21. A central longitudinal bore 32, which discharges into a transverse bore 40, is disposed in the end of the second valve body 31 facing away from the first valve body 26.

The position shown in FIG. 2 of the control valve of the invention will be called the first switching position. In the first switching position, the connection between the low-pressure chamber and the pump chamber is interrupted. When the first valve body 26 is moved toward the second valve body 31 by a stroke $h_1$, the first valve seat face 27 lifts away from the first valve seat edge 28, and a flow course is opened up from the connecting conduit 23, past the first valve seat face 27, through the transverse bore 40 and the longitudinal bore 32 in the second valve body 31, to the connecting conduit 24 to the low-pressure chamber. A throttle 33, which assures that a so-called preinjection occurs, is embodied in the longitudinal bore 32 in the second valve body 31. When the first valve body 26 together with the second valve body 31 is moved by a stroke $h_2$ as far as a stroke end stop 35, counter to the prestressing force of a closing spring 34, the second valve seat face 37 lifts away from the associated valve seat edge 38 as well. A connection between the connecting conduit 23 to the pump chamber and the connecting conduit 24 to the low-pressure chamber is then opened up, which bypasses the throttle 33 in the second valve body 31.

By the introduction of the supplementary throttle 13, 33, it is possible in the case of short strokes to define a preinjection with highly accurate replicability from one UIS to another.

In FIGS. 1 and 2, the strokes $h_1$, and $h_2$ are shown larger than in reality, for the sake of clarity. In actuality, the strokes $h_1$, and $h_2$ are markedly shorter.

The foregoing relates to preferred exemplary embodiments of the invention, it being understood that other variants and embodiments thereof are possible within the spirit and scope of the invention, the latter being defined by the appended claims.

I claim:

1. A unit injector system for internal combustion engines, in particular diesel engines, comprising a pump element for subjecting fuel in a pump chamber to high pressure, an injection element for injecting the pressurized fuel into the combustion chamber of the engine, a control valve which opens and closes a connection between said pump chamber and a low-pressure chamber, and a throttle device (13) disposed in the connection between said pump chamber and said low-pressure chamber, said throttle device controlling flow therethrough as a function of the position of said control valve, wherein said control valve includes a first valve body (6) with a first valve seat face (7) and a second valve body (11) with a second valve seat face (17), which are received, capable of reciprocation, in a housing (1), and wherein in a first valve position, said first valve body (6) is spaced apart from said second valve body (11), and both said first valve body (6) having said first valve seat face (7) and said second valve body (11) having said second valve seat face (17) rest on their associated valve seat edges (8; 18), as a result of which the connection between the pump chamber and a low-pressure chamber is closed;

wherein in a second valve position, said first valve body (6) comes to rest on said second valve body (11), and said first valve body (6) having said first valve seat face (7) lifts from its associated valve seat edge (18) whereby fuel can flow to said throttle (13) in the second valve body (11), said throttle communicating with the low-pressure chamber;

and wherein in a third valve position, said second valve body (11) comes to rest on a stroke end stop (15), and both said first valve body (6) having said first valve seat face (7) and said second valve body (11) having said second valve seat face (17) are lifted from their associated valve seat edges (8; 18), whereby a connection without a throttle (13) is opened up to the low-pressure chamber.

2. The unit injector system in accordance with claim 1, further comprising a groove (10) recessed out of the end face, toward said second valve body (11), of said first valve body (6).

3. The unit injector system in accordance with claim 1, further comprising a groove (16) is embodied on said stroke end stop (15).

4. A unit injector system for internal combustion engines, in particular diesel engines, comprising a pump element for subjecting fuel in a pump chamber to high pressure, an injection element for injecting the pressurized fuel into the combustion chamber of the engine, a control valve which opens and closes a connection between said pump chamber and a low-pressure chamber, and a throttle device (33) disposed in the connection between said pump chamber and said low-pressure chamber, said throttle device controlling flow therethrough as a function of the position of said control valve, wherein said control valve includes a first valve body (26) with a first valve seat face (27) and a second valve body (31) with a second valve seat face (37), which are received, capable of reciprocation, in a housing (21), and wherein said first valve body (26) has a central bore (30), in which part of said second valve body (31) is displaceably received;

wherein in a first valve position, said first valve body (26) is spaced apart from a stroke stop on said second valve body (31), and both said first valve body (26) having said first valve seat face (27) and said second valve body (31) having said second valve seat face (37) rest on their associated valve seat edges (28, 38), whereby said connection between said pump chamber and said low-pressure chamber is closed;

wherein in a second valve position, said first valve body (26) comes to rest on said stroke stop of said second valve body (31), and said first valve body (26) having said first valve seat face (27) lifts from its associated valve seat edge (28), whereby fuel can flow to a throttle (33) in the second valve body (31), which throttle communicates with said low-pressure chamber;

and wherein in a third valve position, said second valve body (31) comes to rest on a stroke end stop (35), and both said first valve body (26) having said first valve seat face (27) and said second valve body (31) having said second valve seat face (37) are lifted from their associated valve seat edges (28, 38), whereby a connection to said low-pressure chamber without a throttle (33) is opened up.

5. The unit injector system in accordance with claim 4, wherein said second valve body (31) in the built-in state is substantially balanced in terms of force.

6. The unit injector system in accordance with claim 2, further comprising a groove (16) is embodied on said stroke end stop (15).

7. The unit injector system in accordance with claim 1, wherein said throttle (33) has a constant flow diameter.

8. The unit injector system in accordance with claim 4, wherein said throttle (33) has a constant flow diameter.

* * * * *